United States Patent [19]

Martin

[11] 4,048,928

[45] Sept. 20, 1977

[54] APPARATUS FOR DISCHARGING CINDERS FROM AN INCINERATOR

[76] Inventor: Johannes Josef Martin, Leopoldstrasse 248, 8000 Munich 40, Germany

[21] Appl. No.: 719,147

[22] Filed: Aug. 31, 1976

[30] Foreign Application Priority Data

Sept. 5, 1975 Germany ..... 2539615

[51] Int. Cl.[2] ..... F23J 1/06

[52] U.S. Cl. ..... 110/165 R; 110/171

[58] Field of Search ..... 110/165 R, 166, 167, 110/169, 170, 171

[56] References Cited

U.S. PATENT DOCUMENTS

| | | | |
|---|---|---|---|
| 2,037,990 | 4/1936 | Martin | 110/171 |
| 2,160,026 | 5/1939 | Martin | 110/171 |
| 2,600,896 | 6/1952 | Martin | 110/165 |
| 3,783,803 | 1/1974 | Martin et al. | 110/165 |

*Primary Examiner*—Kenneth W. Sprague
*Attorney, Agent, or Firm*—Michael J. Striker

[57] ABSTRACT

An apparatus for discharging cinders from an incinerator has an upwardly open intake pit having horizontally spaced front and rear walls. A water-filled trough is provided below this intake pit and has an upwardly concave floor and defines an upwardly extending outlet for cinders which have been quenched after they have dropped down in the pit into the water in the trough. A stepped plunger has a front face slidable in an arcuate path along the floor of the trough between a retracted position relatively close to the front wall defining the pit and an advanced position relatively far from the front wall. This plunger also has an upper surface on which is provided a step having a face which lies in back of the front wall in the retracted position of the plunger and between the walls in the advanced position. Thus as the plunger is advanced from the retracted to the advanced position the step pushes large objects against the rear wall of the pit and compresses these large objects. In addition, this step is inclined so as to exert a downward component of force on material in the pit and press it against the floor of the trough.

18 Claims, 5 Drawing Figures

Fig.1
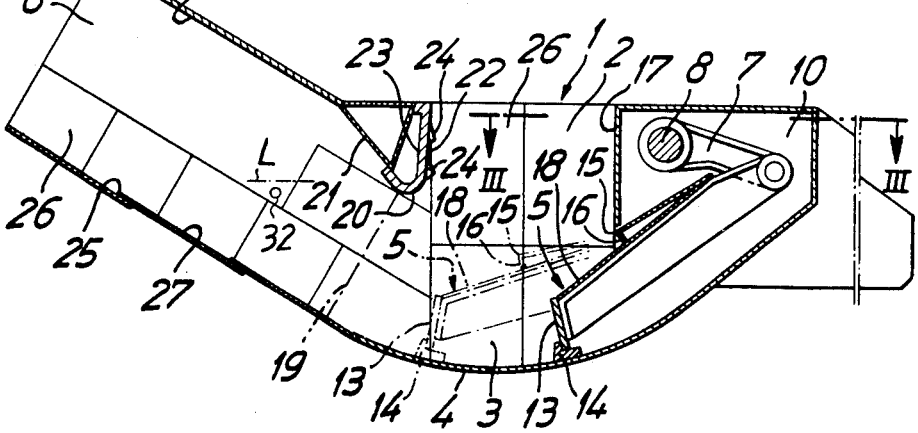
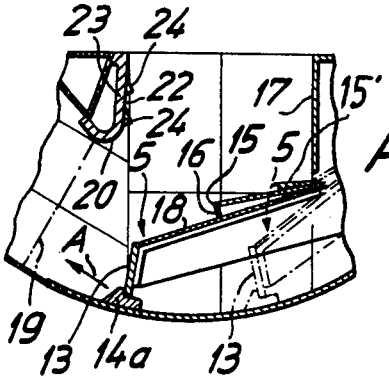
Fig.1a
Fig.2
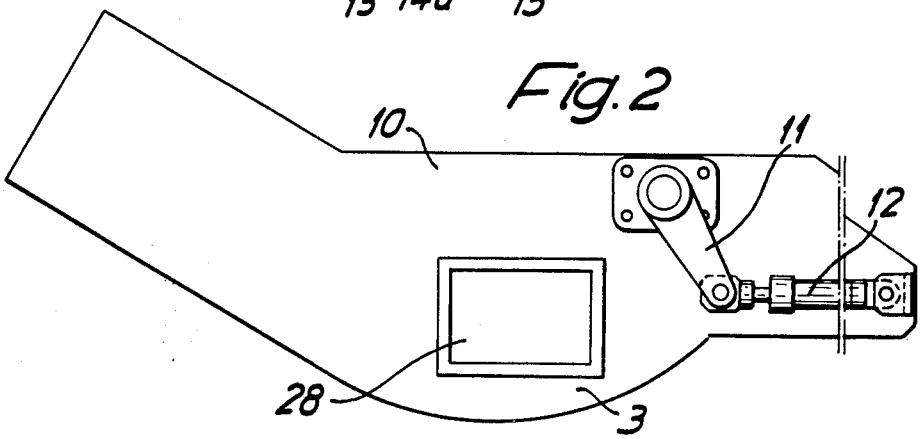

APPARATUS FOR DISCHARGING CINDERS FROM AN INCINERATOR

BACKGROUND OF THE INVENTION

The present invention relates to an apparatus for discharging bulk material. More particularly this invention concerns an apparatus for discharging cinders from the bottom of an incinerator.

It is known to provide a discharge mechanism in the bottom of a furnace wherein coal or the like is burned which comprises an upwardly open pit into which the cinders and the like drop. A water-filled trough at the base of this pit is provided with a horizontally displaceable plunger or pusher which can be reciprocated to displace cinders which have dropped into the trough laterally therefrom. As soon as the cinders hit the water they are quenched, and this water also forms a fluid seal which prevents potentially harmful gases from escaping from the furnace, incinerator, or the like. Such an arrangement, as described in German Pat. Nos. 867,121 and 972,396 as well as in my earlier U.S. Pat. No. 3,734,037, works extremely well so long as the material being discharged is of relatively even consistency, that is so long as no large bulky objects are present in the bulk material being discharged.

When, however, it is necessary to discharge the cinders from the bottom of an incinerator being used to burn up missellaneous refuse, problems frequently occur. In particular when large incombustible or uncombusted masses, such as motors, engine blocks, and the like, fall into the discharge arrangement, this arrangement can become jammed. Such jamming is usually due to the fact that the main face of the plunger does not pull all the way back from beneath the pit. More often this main face simply pulls approximately half way back, so that if the jamming object cannot fit between it and the edge of the pit it will merely remain on top of the plunger as this plunger reciprocates back and forth. In order to pull the plunger all the way back it is necessary to redimension the entire device and otherwise redesign it, which is not practical in most applications.

SUMMARY OF THE INVENTION

It is therefore an object of the present invention to provide an improved apparatus for discharging bulk material.

Another object is to provide a cinder-discharging apparatus which overcomes the above disadvantages.

Yet another object is to provide a discharge apparatus for an incinerator which is not likely to be jammed by relatively bulky objects.

These objects are attained according to the present invention by forming the plunger on its upper surface with a step which pulls all the way back under the corresponding wall of the cinder-receiving pit in the retracted position of this plunger. In addition the face of this step is so inclined relative to the upwardly concave bottom or floor of the water-filled trough that when the plunger is reciprocated from the retracted into the advanced position this step face exerts a component of force on the quenched cinders toward the floor of the trough. Thus this step at least can engage against a relatively bulky object in the pit and move it toward the outlet or precompress it. After several reciprocations this step will reduce virtually any overly large object to a size small enough to drop in front of the main face of the plunger and, thence, to be pushed out of the apparatus.

According to another feature of this invention the plunger is provided on its upper surface with several such steps spaced apart in the direction of displacement of the plunger. This arrangement further increases the precompressing that can be effected by the arrangement. The step on the top surface of the plunger according to a further feature of this invention lies in the advanced position of the plunger ahead of the position assumed by the main face of the plunger in the retracted position of this plunger. Thus anything that is pushed ahead by the step will inherently be able to fit between the main face of the plunger and the outlet. The outlet and the inlet pit are both of substantially the same cross section. In addition the cross sections of each of these outlets and inlets may increase slightly in the downstream direction. In particular the rear wall toward which the plunger moves as it is displaced from its retracted to its advanced position has a lower edge which constitutes the narrowest part of the outlet, whereas the narrowest part of the inlet is formed by the upper region of the pit. Thus the likelihood that something can wedge in either the inlet or the outlet is greatly reduced.

In order to reduce wear in the arrangement the plunger is provided at the edge of its main face that contacts the floor of the trough with a replaceable shoe. The front face of this shoe may extend, in accordance with the invention, at an obtuse angle to the adjoining floor. This prevents material from becoming wedged between the plunger and the floor. This shoe therefore tends to push the material up whereas the face of the step pushes it downwardly so that it can move most readily to and through the outlet. The outlet is formed by a plurality of replaceable plates which overlap one another shiplap-style so as to form steps that prevent the material from sliding back down the upwardly inclined outlet of the trough.

According to yet another feature of this invention the rear end of the plunger, that is its end opposite its main pushing face, is pivoted on a pair of arms whose other ends are secured to a common axle. Thus the plunger can follow an arcuate path, which has been found to be greatly more effective than the straight path followed by plungers in some prior-art arrangements. It is possible to connect hydraulic rams via cranks to this axle in order to operate the plunger, or to provide a single hydraulic ram connected in the center of the plunger for reciprocating it. In both cases the particular mounting according to this invention ensures that the face of the plunger will not cant, that is will remain parallel to the axle axis.

According to a further feature of this invention the rear wall of the pit, that is that wall against which any material is likely to be crushed by the step on the plunger, is formed as a removable and replaceable part. It has a rounded lower edge and is provided along its face turned toward the plunger with teeth that prevent material from sliding up on this element. In addition the surface defined by this element tips slightly away from the opposite wall of the pit so that the cross-sectional area of the arrangement at the pit increases slightly. The radius of curvature of the rounded edge is approximately one-tenth the transverse width of the pit measured in a horizontal direction in the same plane as the direction of movement of the plunger. Such a formation prevents sheet metal or the like from being wrapped tightly around this edge and becoming lodged in place. Such an arrangement also eliminates the necessity for crushing rollers or the like which are often provided in such installations and serve to break up larger clumps of cinders.

Since, as described above, the face of the step is effective with a downward component of force on the cinders and the like, the device is particularly effective. Cinders are not simply pushed back up in the pit each time the plunger moves forward, but instead are directly pressed out the outlet.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a vertical section through an apparatus according to this invention;

FIG. 1*a* is a view corresponding to a detail of FIG. 1 showing an alternative arrangement;

FIG. 2 is a side view similar to FIG. 1;

SPECIFIC DESCRIPTION OF A PREFERRED EMBODIMENT

Figure 3:
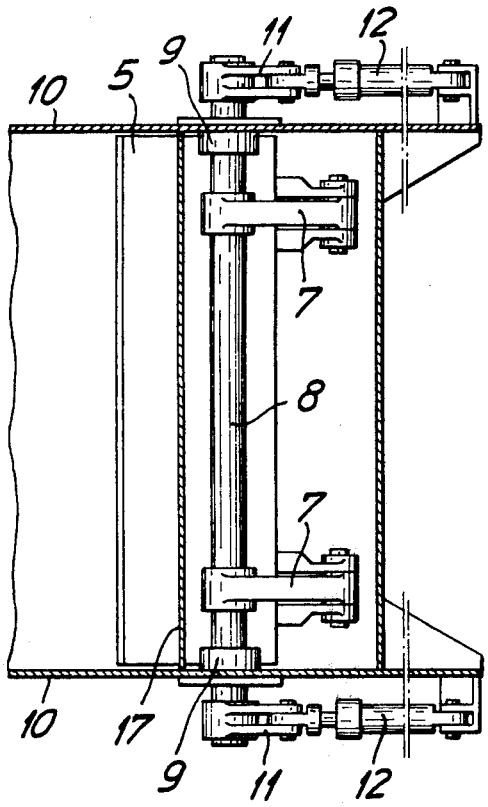
FIG. 3 is a section taken along line III—III of FIG. 1.

As shown in FIGS. 1 and 2 an apparatus 1 for discharging cinders from an overlying incinerator has a cinder pit 2 which opens upwardly toward the incinerator and downwardly into a trough 3 filled with water through a hole 32 to a level L. The trough 3 has a floor 4 of upwardly concave shape along which a pusher or plunger 5 may reciprocate. In addition the trough 3 is provided with an upwardly extending outlet 6 from which the quenched cinders may issue.

As also shown in FIG. 3 a shaft 8 carries a pair of arms or cranks 7 pivoted at their outer ends to the rear end of the piston 5. This shaft 8 passes through journals 9 in the side walls 10 of the apparatus 1 and is provided on each of its outer ends with a further arm or crank 11 connected to one end of a respective cylinder 12. Thus expansion of these cylinders 12 will move the piston 5 from the solid-line retracted position shown in FIG. 1 to the dot-dash line advanced position shown in FIG. 1.

Figure 4:
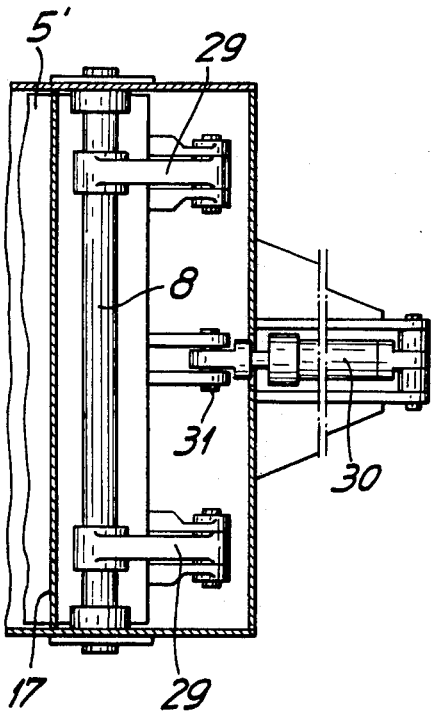
FIG. 4 is a view similar to FIG. 3 illustrating another arrangement in accordance with the present invention.

It is also possible as shown in FIG. 4 to mount a piston 5' indentical to the piston 5 via arms 29 on the shaft 8 and use a single hydraulic ram 30 connected at 31 in the middle of the plunger 5'.

The plunger 5 has a planar main face 13 which is substantially perpendicular to the floor 4 or inclined at an angle of between 10° and 20°, preferably 15° to a plane perpendicular to the immediately adjacent portion of the floor 4 in the direction to form an obtuse angle with the adjacent portion of the floor 4. This main face 13 is provided at its lower edge with a shoe 14 having a front face forming an obtuse angle with the corresponding portion of the floor, and adapted to slide along the floor 4. The shoe 14 is replaceable.

FIG. 1*a* shows a shoe 14*a* which forms a substantially larger obtuse angle, here approximately 135°, with the corresponding portion of the floor 4. In FIG. 1*a* the advanced position is shown in solid lines and the retracted position in dot-dash lines.

As again shown in FIG. 1 the piston 5 is formed on its upper surface 18 with a step 15 having a face 16 turned toward the outlet 6. It is also possible as shown in FIG. 1*a* to provide a second such step 15 in back of the first step. The planar face 16 is generally perpendicular to the upper surface 18 of the piston 5, and this surface 18 normally lies at a very small acute angle to the corresponding portion of the floor 4 against which the shoe 14 is engaging. Thus when moved from the solid-line to the dot-dash line position the face 16 will exert a downward component of force on any cinders in the apparatus 1 so as to push them against this floor 4 and up out the chute 6 in the direction of arrow A.

Thus, the piston 5 is movable between the solid-line position where the step 15 lies slightly behind the front wall 17 of the pit 2 into the dot-dash line position where it lies well ahead of this wall. Even in the retracted position, however, the face 13 lies well ahead of the wall 17 so that it is possible that some item could be, at least to start with, too wide to fit between the face 13 so as to be pushable in the direction A out through the mouth 19 of the outlet conduit 6.

The other wall 22 of the pit 2 is formed by a cast element 23 having a rounded lower edge 20 and, on its surface turned toward the wall 17, with downwardly directed sawteeth ridges 24. A transition plate 21 leaves from the rounded edge 20 to the upper wall 21*a* of the outlet 6 so that the cross-sectional area of this outlet 6 is the smallest at the edge 20. A large object that cannot fit between the face 13 and the edge 20 will, therefore, be pressed by the step 15 against this edge 20. The replaceability of the element 23 makes it possible to renew this portion of the device which will be subjected to extremely heavy wear.

The outlet passage 6 is formed with bottom plates 17 defining steps 25 and side plates 26. Thus it is possible to replace these plates 26 and 27 when the device has worn. In addition, the steps 25 like the sawtooth ridges 24 will prevent material from moving back into the region of the trough 3 adjacent the piston 5.

In case the arrangement does become jammed it is possible to open a relatively large door 28 shown in FIG. 2 to gain access to the bottom of the pit 2 or the interior of the trough 3.

With the apparatus according to the present invention relatively large objects will be crushed or precompressed between the step 15 and the element 23 so that they can thereafter be pushed up out the outlet 6. Other more fluent bulk material will simply be pressed by the face 13 up the outlet 6 in the normal fashion. After the device wears it is possible to replace the shoe 14, the element 23, and the plates 26 and 27 in order to renew it and increase its service life considerably.

It will be understood that each of the elements described above, or two or more together, may also find a useful application in other types of machine differing from the types described above.

While the invention has been illustrated and described as embodied in a cinder-discharge apparatus, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An apparatus for discharging cinders, said apparatus comprising: an intake having horizontally spaced front and rear walls defining an upwardly open cinder-receiving pit; a water-filled trough below said intake having an upwardly concave floor and defining an upwardly extending outlet for quenched cinders extending under said rear wall and away from said pit, whereby cinders falling into said trough through said pit are quenched by the water in said trough; a stepped plunger having a front face slidable in an arcuate path along said floor between a retracted position relatively close to said front wall and an advanced position relatively far from said front wall, an upper surface turned toward and alignable under said pit, and a step face turned toward said outlet and lying in back of said front wall in said retracted position and between said walls in said advanced position; and means for advancing said plunger between said positions and thereby sweeping said front wall in said arcuate path across said floor and pushing quenched cinders in said trough with said faces toward said outlet, said step face being inclined relative to said floor so as to exert on said quenched cinders on advance of said plunger from said retracted into said advanced position a component of force toward said floor.

2. The apparatus defined in claim 1 wherein said plunger is provided with at least one additional such step face on said upper surface and spaced from the first-mentioned step face in the direction of displacement of said plunger.

3. The apparatus defined in claim 1 wherein said step face assumes in said advanced position of said plunger a position closer to said front wall than said main face of said plunger assumes in said retracted position.

4. The apparatus defined in claim 1 wherein said plunger is provided at the edge of its main face that contacts the floor of the trough with a removable shoe sliding on said floor.

5. The apparatus defined in claim 4 wherein said shoe has a face turned toward said outlet and lying at an obtuse angle to said floor.

6. The apparatus defined in claim 1 wherein said means includes at least one hydraulic ram having a fixed end and an opposite end operatively connected to said plunger.

7. The apparatus defined in claim 6 wherein said opposite end is secured in the middle of said plunger.

8. The apparatus defined in claim 6 wherein said means includes an axle perpendicular to the direction of displacement of said plunger and a pair of arms connected between said axle and said plunger.

9. The apparatus defined in claim 8 wherein said means includes a pair of such rams and a pair of cranks each between a respective opposite end and said axle.

10. The apparatus defined in claim 1 wherein said pit and said outlet are of generally the same cross-sectional area.

11. The apparatus defined in claim 10 wherein said outlet is of increasing cross-sectional area from said rear wall.

12. The apparatus defined in claim 10 wherein said rear wall has a rounded lower edge at said outlet.

13. The apparatus defined in claim 12 wherein said rear wall has a removable edge strip constituting said lower edge.

14. The apparatus defined in claim 10 wherein one of said walls is provided with horizontally extending teeth.

15. The apparatus defined in claim 10 wherein said pit is of downwardly increasing cross-sectional area.

16. The apparatus defined in claim 10 wherein said floor is formed with steps transverse to the direction of displacement of said plunger.

17. The apparatus defined in claim 16 wherein said floor is constituted by a plurality of overlapping plates having edges forming said steps.

18. The apparatus defined in claim 10, further comprising an openable door at said pit.

* * * * *